US010550628B2

(12) United States Patent
Runze et al.

(10) Patent No.: US 10,550,628 B2
(45) Date of Patent: Feb. 4, 2020

(54) SPACER FOR INSULATING GLASS PANES

(71) Applicant: ENSINGER GMBH, Nufringen (DE)

(72) Inventors: Peter Runze, Schwandorf (DE); Marc Rehling, Steinenbronn (DE); Juliane Gruber, Arnschwang (DE); Bernhard Königsberger, Tiefenbach (DE); Rolf Wollenberg, Traitsching (DE); Rainhard Lommer, Chamerau (DE); Heinz Raunest, Weiding (DE)

(73) Assignee: ALU PRO S.r.l., Noale (Ve) (IT)

( * ) Notice: Subject to any disclaimer, the term of this patent is extended or adjusted under 35 U.S.C. 154(b) by 0 days.

(21) Appl. No.: 16/014,272

(22) Filed: Jun. 21, 2018

(65) Prior Publication Data

US 2018/0298674 A1 Oct. 18, 2018

Related U.S. Application Data

(63) Continuation of application No. PCT/EP2016/076656, filed on Nov. 4, 2016.

(30) Foreign Application Priority Data

Dec. 23, 2015 (DE) ..... 10 2015 122 714

(51) Int. Cl.
*E06B 3/663* (2006.01)
*E06B 3/22* (2006.01)

(52) U.S. Cl.
CPC ..... *E06B 3/66319* (2013.01); *E06B 3/221* (2013.01); *E06B 3/66328* (2013.01); *E06B 3/66361* (2013.01); *E06B 2003/66385* (2013.01)

(58) Field of Classification Search
CPC ..... E06B 3/66328; E06B 3/66333; E06B 3/66319; E06B 3/66314; E06B 3/66313;
(Continued)

(56) References Cited

U.S. PATENT DOCUMENTS 4,719,728 A 1/1988 Eriksson et al.
4,856,243 A * 8/1989 Ault ..... E06B 3/677 52/209

(Continued)

FOREIGN PATENT DOCUMENTS

DE 102010015836 A1 * 10/2011 ..... E06B 3/66319
DE 10 2010 049 806 A1 5/2012

(Continued)

OTHER PUBLICATIONS

International Search Authority, International Search Report for International Application No. PCT/EP2016/076656, dated Dec. 22, 2016.

(Continued)

*Primary Examiner* — Jessie T Fonseca
(74) *Attorney, Agent, or Firm* — Leydig, Voit & Mayer, Ltd.

(57) ABSTRACT

A spacer for insulating glass panes has a profile body configured as a closed hollow profile substantially closed in cross section, the profile body having first and second side walls in parallel spaced apart from each other, an inner wall extending between the first and second side walls, and an outer wall extending from the first to the second side wall spaced apart from the inner wall. The outer wall comprises a first wall section aligned substantially parallel to the inner wall, second and third wall sections arranged on both sides of the first wall section, the latter, in cross section to the axial direction of the body, aligned at an obtuse angle to the first wall section and to the respective adjacent side wall, and connect thereon. The spacer includes an integral, reinforcing element, extending from the first side wall over the outer wall to the second side wall.

36 Claims, 6 Drawing Sheets

(58) Field of Classification Search
CPC ..... E06B 3/663; E06B 2003/66385; E06B 2003/6638
See application file for complete search history.

(56) References Cited

U.S. PATENT DOCUMENTS

| | | | | | |
|---|---|---|---|---|---|
| 4,890,438 | A * | 1/1990 | Tosa | E06B 3/66342 | 52/172 |
| 5,079,054 | A * | 1/1992 | Davies | B29C 70/52 | 428/213 |
| 5,106,663 | A * | 4/1992 | Box | E06B 3/66342 | 156/109 |
| 5,962,090 | A * | 10/1999 | Trautz | E06B 3/66319 | 428/34 |
| 6,389,779 | B1 * | 5/2002 | Brunnhofer | E06B 3/66319 | 428/34 |
| 7,827,760 | B2 * | 11/2010 | Brunnhofer | E06B 3/66319 | 52/309.13 |
| 8,756,879 | B2 * | 6/2014 | Cempulik | E06B 3/66319 | 52/172 |
| 2015/0107167 | A1 | 4/2015 | Baumann et al. | | |

FOREIGN PATENT DOCUMENTS

| | | | | |
|---|---|---|---|---|
| EP | 2 930 296 | A1 | 10/2015 | |
| WO | WO 2014/005950 | A1 | 1/2014 | |
| WO | WO-2014005950 | A1 * | 1/2014 | E06B 3/66319 |
| WO | WO-2014063801 | A1 * | 5/2014 | E06B 3/66319 |

OTHER PUBLICATIONS

International Bureau, English translation of International Preliminary Report on Patentability in International Application No. PCT/EP2016/076656, dated Jul. 5, 2018.

* cited by examiner

SPACER FOR INSULATING GLASS PANES

CROSS-REFERENCE TO RELATED APPLICATIONS

This patent application is a continuation of International Patent Application No. PCT/EP2016/076656 filed on Nov. 3, 2016, which claims the benefit of German Patent Application No. 10 2015 122 714.2, filed on Dec. 23, 2015, which are each incorporated herein by reference.

BACKGROUND OF THE INVENTION

The invention relates to a spacer for insulating glass panes, as they are used frequently in the manufacture of windows, doors, facade elements, etc.

The spacer typically comprises a profile body configured as a closed hollow profile, which is substantially rectangular in cross section, wherein the profile body has a first and a second side wall arranged in parallel to each other and spaced apart from each other, an inner wall extending between the first and second side walls, and an outer wall extending from the first to the second side wall. The outer wall is spaced apart from the inner wall and has a first wall section aligned substantially in parallel to the inner wall, and second and third wall sections arranged on both sides of the first wall section, which, seen in cross section perpendicular to the axial direction of the profile body, are aligned at an obtuse angle to the first wall section and the respective adjacent side wall, and connect thereon. At least the inner wall, the first and the second side wall, and the second and third wall sections of the outer wall are made from a first plastics material. The spacer further has an integral, primary reinforcing element, which is configured as a vapor diffusion barrier, extending from the first side wall over the outer wall to the second side wall.

Spacers for insulating glass panes of this kind are disclosed in the prior at, for example in U.S. Pat. No. 4,719,728, WO 2014/005950 A1, and in DE 10 2010 049806 A1.

There is often the requirement of being able to form the spacers for insulating glass panes to a frame in a cold bending method, wherein the external geometry in the case of the thusly formed corner regions of the frame, in particular in the region of the side walls, should remain as unchanged as possible, such that a precise abutment of the spacers with the side walls on the glass panes of the insulating glass panes may be ensured.

Furthermore, it is of importance to design the profile body such that the interspace between the panes present in the insulating glass panes is able to be kept substantially free of water vapor, and thus condensation effects in the case of large differences between the indoor and outdoor temperature may be avoided. For this purpose, the spacers are filled in their hollow profile with desiccant, for example, for which only a limited volume is available, however, such that the gas-tight, in particular moisture-tight, sealing of the interspace between the panes against the environment by way of the spacer is of crucial importance.

Moreover, a certain mechanical stability is required by the spacers, so that they may be processed in a simple manner using conventional cold bending methods.

The spacers in accordance with the invention are used, as disclosed in the prior art, for the improvement of the heat insulation in insulating glass panes of windows, doors, facade elements, and the like, in place of the previously common metal spacers, in order to keep the glass panes spaced apart.

The bendability for the production of the frames, on the one hand, but also the longitudinal stability of the spacers, on the other, are of great importance during processing.

The object of the present invention is to propose a spacer that is able to be deformed in particular in the cold bending method using conventional equipment, offers a greatest possible heat transmission resistance, and moreover may be produced economically.

BRIEF SUMMARY OF THE INVENTION

This object is achieved in accordance with the invention with the features of claim 1.

A sufficient stability of the spacer, on the one hand, and a good cold deformability, on the other, is achievable, because, for one, the spacer in accordance with the invention has a primary reinforcing element which is integrally formed and extends from the first to the second side wall, which is simultaneously configured as a vapor diffusion barrier, as is disclosed per se in the prior art, wall regions are provided in combination therewith, which form articulation areas, by way of which the outer wall connects to the first and second side walls, respectively.

In particular due to the articulation areas present at the changeover from the side walls to the outer wall and their second and third sections, respectively, in combination with the integral, primary reinforcing element, the cold bendability is improved in a controlled manner, such that the mechanical stress of the profile body upon bending is reduced. This enables an optimization of the wall thicknesses of the inner wall, the side walls, and also of the outer wall, insofar as the latter is produced from a plastics material.

This leads not only to a further increase in the heat transmission resistance, but rather also reduces material costs and simplifies the handling, in particular in the cold bending method, for example by reducing the so-called overbending angle.

DETAILED DESCRIPTION OF THE INVENTION

The second and third wall sections of the outer wall are preferably configured to be substantially planar, whereby an external contour of the spacer is achieved that offers sufficient space for the application of an adhesive when mounting the spacer between the panes of the insulating glass panes.

The primary reinforcing element is preferably configured as metal foil, in particular as stainless steel foil. Further preferably, the thickness of the metal foil is limited to about 0.1 mm or less, in particular to about 0.09 mm or less. Such thin metal foils are still able to fulfill their function as primary reinforcing element, but simultaneously reduce the heat transfer compared to more thickly dimensioned foils.

With respect to the regions of the profile body that are produced from plastics material, the inner and outer walls may be provided with pores, in particular closed pores, at least in portions, and be produced from foamed plastics material, for example. These embodiments enable a further improvement of the heat transmission resistance, without negatively affecting the processing in the cold bendability or the mechanical properties of the spacer being substantially impaired.

Also the side walls may be provided with a porous structure, which is in particular selected, in turn, to be closed-pore. The profile body may, as needed, also substantially entirely be produced having a porous, in particular closed-pore structure.

Profile bodies having partial or in the entire cross section porous structure (foam structure) surprisingly have the further advantage that, due to the foam structure, the so-called overbending angle or, expressed differently, the restoring behavior during bending in the cold bending method is reduced.

Furthermore, profile bodies having partial or in the entire cross section foam structure have the advantage that the connection of spacer ends by means of corner connectors or also longitudinal connectors works more simply and, moreover, due to the compressibility of the foam structure, an improved form fit with the surface structuring present on the side of the corner and longitudinal connectors is achievable.

In a particular embodiment of the spacer in accordance with the invention, provision is made for the outer wall to be partially formed by the primary reinforcing element, wherein preferably at least the first wall section of the outer wall is substantially entirely formed by the primary reinforcing element. This saves, for one, not only plastics material and thus costs and weight, but furthermore also provides a larger volume in the hollow profile for accommodating desiccant, with the same constructional height.

If no higher volume for accommodating the desiccant is required, the constructional height of the spacer may be overall reduced—with the advantage that, in addition to a material savings, also the net weight of the profile body may be reduced. A lesser constructional height of the spacer also reduces the heat transfer coefficient for the rim connection of the insulating glass pane, wherein limits on the reduction of the constructional height of the spacer are set by the required mechanical stability of the rim connection.

Alternatively, provision may be made for the first wall section of the outer wall to be made from a second plastics material, wherein the second plastics material of the first wall section of the outer wall is preferably compatible with or optionally identical to the first plastics material.

Further preferably, the first wall section of the outer wall, if it is made from the second plastics material, is integrally formed with the profile body, wherein in particular extrusion or coextrusion is suitable here.

Furthermore, it may be advantageous to connect the first wall section to the second and third wall sections by way of wall regions that have a lesser wall thickness and thus form articulation areas. The articulation areas between the first and the second and third wall sections of the outer wall, respectively, have the additional effect of increasing the heat transfer resistance of the outer wall. This effect, even if only to a small extent, is also observed at the articulation areas provided between the second and third wall sections of the outer wall and the respective associated side walls.

The reduced wall thickness for the formation of articulation areas may also be extended to adjacent wall regions, in particular of the outer wall, such that, for example, commencing from the articulation areas, in each case up to about a third of the extension of the outer wall in transverse direction of the spacer has a reduced wall thickness.

Preferably, the wall regions configured as articulation areas are conceived as grooves formed in the interior of the hollow profile of the profile body, such that a lowest possible resistance on the side of the plastics material in the articulation areas arises in the case of a deformation of the spacer upon forming corner regions as part of the cold deformation, because the regions that in particular would otherwise be subject to a compression, are omitted by the formation of the groove.

Moreover, the deformation of the spacer on its outer side during the cold bending may be influenced to a certain extent by way of the design of the groove, such that this region may specifically undergo a deformation.

According to size, in particular width, of the spacer, it may be advantageous if a first and a second secondary reinforcing element are arranged in the inner wall of the spacer in parallel to the axial direction of the spacer, wherein the first primary reinforcing element is arranged in a section of the inner wall adjacent to the first side wall and the second secondary reinforcing element is arranged in a second section of the inner wall adjacent to the second side wall.

The secondary reinforcing elements are preferably arranged in the inner wall with a spacing to the respective side walls that corresponds to about 10 to about 40%, further preferably about 30% to about 35%, of the spacing between the side walls. Thus, the profile geometry may be adapted to the tools used in the bending operation.

Further, the secondary reinforcing elements may preferably be arranged in the inner wall with a spacing to the respective side wall adjacent thereto of about 1 mm to about 5 mm, further preferably about 1 mm to about 3 mm.

In each case the spacing of the center (in the case of circular cross section) of the secondary reinforcing elements to the respective adjacent side wall is defined as the spacing. In the case of a cross section deviating from the circular shape, its geometric center is to be used in place of the center for determining the spacing.

The secondary reinforcing elements may in particular be provided with a wire-shape, wherein flat wires also prove to be suitable with respect to a smallest possible wall thickness of the inner wall.

The reinforcing elements, in particular in wire-shape, also in the form of the flat wires, preferably have on their outer side a structuring, in particular corrugation or other contouring transverse to their longitudinal direction, such that these reinforcing elements may be introduced into the surrounding plastics material in a manner resistant to shear force, and thus simultaneously may take over the function of delimiting the thermal longitudinal elongation of the profile of the spacer. Alternatively or in addition, the secondary reinforcing elements may also be equipped with a bonding mediator layer. Further, the secondary reinforcing elements may also be equipped with a layer of adhesive, for example from a so-called hotmelt adhesive.

For accommodating the secondary reinforcing elements in the inner wall, they preferably have thickenings or projections extending into the cavity of the hollow profile, which are matched substantially to the contour of the secondary reinforcing elements. In these regions which have a greater wall thickness compared to the adjacent regions of the inner wall, the secondary reinforcing elements are able to be securely embedded. In particular it is thereby avoided that the reinforcing elements, as the case may be, exit the plastics material of the inner wall during the cold bending and thereby lose physical contact to the inner wall. Also when cutting the spacer to length by way of sawing, a secure embedding of the secondary reinforcing element in the inner wall is advantageous, so that the reinforcing elements in the cutting region are not ripped out.

The greater wall thickness in the region of the projections is preferably based on the thickness of the secondary reinforcing elements, measured correspondingly to their orientation and perpendicularly to the surface of the inner wall.

Further preferably, the inner wall, at least in its regions in which the first and second reinforcing elements are arranged, has a thickness that is about 1.5 to about 3.5-fold, in particular 1.6 to about 2.9-fold, of the extension of the cross section of the primary reinforcing elements in this direction.

In order to improve the cold bendability of the spacers in accordance with the invention that have secondary reinforcing elements, and in particular such ones that accommodate the reinforcing elements in projections that extend into the cavity of the hollow profile, provision is preferably made for the outer wall in regions that lie opposite the positions of the secondary reinforcing elements to have a recess that preferably corresponds to about a fourth to about half, further preferably about a third to about half of the thickness of the secondary reinforcing elements and/or corresponds to the contour of the projections of the inner wall.

The plastics materials from which the first and also the second plastics material are preferably selected comprise polypropylene (PP), polycarbonate (PC), polyvinylchloride (PVC), styrene-acrylonitrile-copolymer (SAN), polyester, in particular polyethylene terephthalate (PET), polyamide (PA) and acrylonitrile butadiene styrene copolymer (ABS) individually or in admixture with each other.

Polycarbonate (PC), polypropylene (PP), and polyester, in particular polyethylene terephthalate (PET), may be used to a partial or full extent in the form of recyclate for the first and second plastics materials. This reduces the material costs, while the requirements for the mechanical strength values of the spacer profiles in accordance with the invention may still be satisfied.

Likewise, biodegradable or bio-based polymers, for example low-molecular polyamide (PA), polyester, polyvinyl alcohol (PVA), polybutylene adipate terephthalate (PBAT), polybutylene succinate (PBS), polycaprolactone (PCL), and polyglycolide (PGA) and starch, respectively, saccharose, polyactide (PLA), polyhydroxybutyrate (PHB), thermoplasts on the basis of lignins, and epoxy acrylates on the basis of oils may be used as the first and/or second plastics material.

These recyclates and biodegradable plastics materials are preferably used together with fillers selected from natural fibers. Preferably used natural fibers are selected from coir, hemp fibers, sisal fibers, flax and wood fibers. The natural fibers do not lead to an improvement of the mechanical properties to the same extent as the thermoplastic fibers or even the glass fibers, but do additionally provide an improvement of the heat insulation properties of the plastics materials, however.

The weight ratio of the weight of the primary reinforcing element to the weight of the first and optionally of the second plastics material is preferably selected in the range of about 1:0.75 to about 1:3.

In the preferred spacers in accordance with the invention, the mechanical stability and in particular also their thermal longitudinal extension behavior may be positively influenced by incorporating reinforcing fibers into the plastics material. This applies both to the first and to the second plastics material.

The amount of reinforcing fibers with respect to their higher heat conductivity compared to the plastics material will preferably be about 20% by weight or less, in particular 10% by weight or less.

In particular inorganic fibers like, for example, glass fibers, balsam fibers, carbon fibers, boron fibers, ceramic fibers, and silicic fibers are used as reinforcing fibers. Preferred organic reinforcing fibers to be used are aramid fibers, polyamide fibers, polyester fibers, polyolefin fibers, and Plexiglas fibers.

Also metal fibers, in particular steel fibers are suitable as reinforcing fibers.

In an alternative embodiment of the spacer in accordance with the invention, the first and/or the second plastics material is free of reinforcing fibers, wherein optimal heat insulation values are hereby achieved.

Further preferably, additives are used in the first and/or second plastics materials, which are selected in particular from fillers, pigments, light stabilizers, impact resistance modifiers, antistatic agents, and/or flame retardants.

Further preferred spacers may have an inner wall that has a reduced thickness in regions directly adjacent to the side wall, compared to the thickness of the regions that extend in the direction to the profile center. These regions having reduced wall thickness also form articulation areas that facilitate the deformation of the spacer in the formation of corner regions upon cold bending the spacer to a frame and contribute to the formation of a specified, controlled geometry of the bent spacer.

This applies in particular if first and second secondary reinforcing elements are arranged in the inner wall.

In the material selection for the primary reinforcing element and the secondary reinforcing elements, it is preferably ensured that the material of the primary reinforcing element has a greater elongation at break than the secondary reinforcing elements that are more subject to a compression during the cold bending process, while the primary reinforcing element, that also extends in the region of the outer wall of the spacer, undergoes an elongation due to tensile forces during the cold bending.

Here it is particular advantageous if the material of the primary reinforcing element has a low yield strength, as it is present in materials not cold-worked further. After annealing, such materials should only be straightened and straightened in a stretch-bending manner, respectively, without thereby noticeably increasing the tensile strength and the yield strength, respectively.

Further preferred spacers are designed such that the first and second secondary reinforcing elements are each arranged adjacent to a part of the hollow volume of the hollow profile, in which the inner wall and the outer wall are also arranged spaced apart from each other after a bending of the hollow profile by 90° about a bending axis running perpendicularly to the axial or longitudinal direction and parallel to the inner wall for the formation of a corner region. This has the advantage that the first and second secondary reinforcing elements do not provide any resistance against the bending operation in the cold bending method that exceeds their actual material stiffness.

Particularly preferable are spacers in which the hollow profile upon a bending has a neutral axis or fiber perpendicular to the longitudinal and parallel to the inner wall, which is in the range of about 40% to about 60% of the total height of the hollow profile.

Further preferable are spacers in which the profile body has an overbending angle for the production of a section bent by 90° in the cold bending method, which is about 20° or less, further preferably about 15° or less.

Preferred spacers have a wall thickness of the inner wall and/or the first, second and third wall sections of the outer wall that is about 0.7 mm to about 1 mm, preferably about 0.7 mm to about 0.9 mm.

Further, the wall thickness at least in one or more regions seen in profile cross section may be in the range of about 0.3 mm to about 0.7 mm. However, in the regions in which a perforation is provided, via which the cavity of the hollow profile communicates with the interspace between the panes, the inner wall will preferably have a regular wall thickness, e.g. of about 0.9 mm. With the regions of reduced wall thickness, in addition to a further improvement of the heat insulation properties of the spacer in accordance with the invention, material is additionally saved and the net weight of the spacer is reduced.

The wall thickness of the side walls is less critical, since these have only a subordinate role with respect to the heat insulation properties of the spacer.

BRIEF DESCRIPTION OF THE SEVERAL VIEWS OF THE DRAWINGS

These and further advantages of the invention are described in more detail below with reference to the drawings. They show in detail.

DETAILED DESCRIPTION OF THE DRAWINGS

Figure 1:
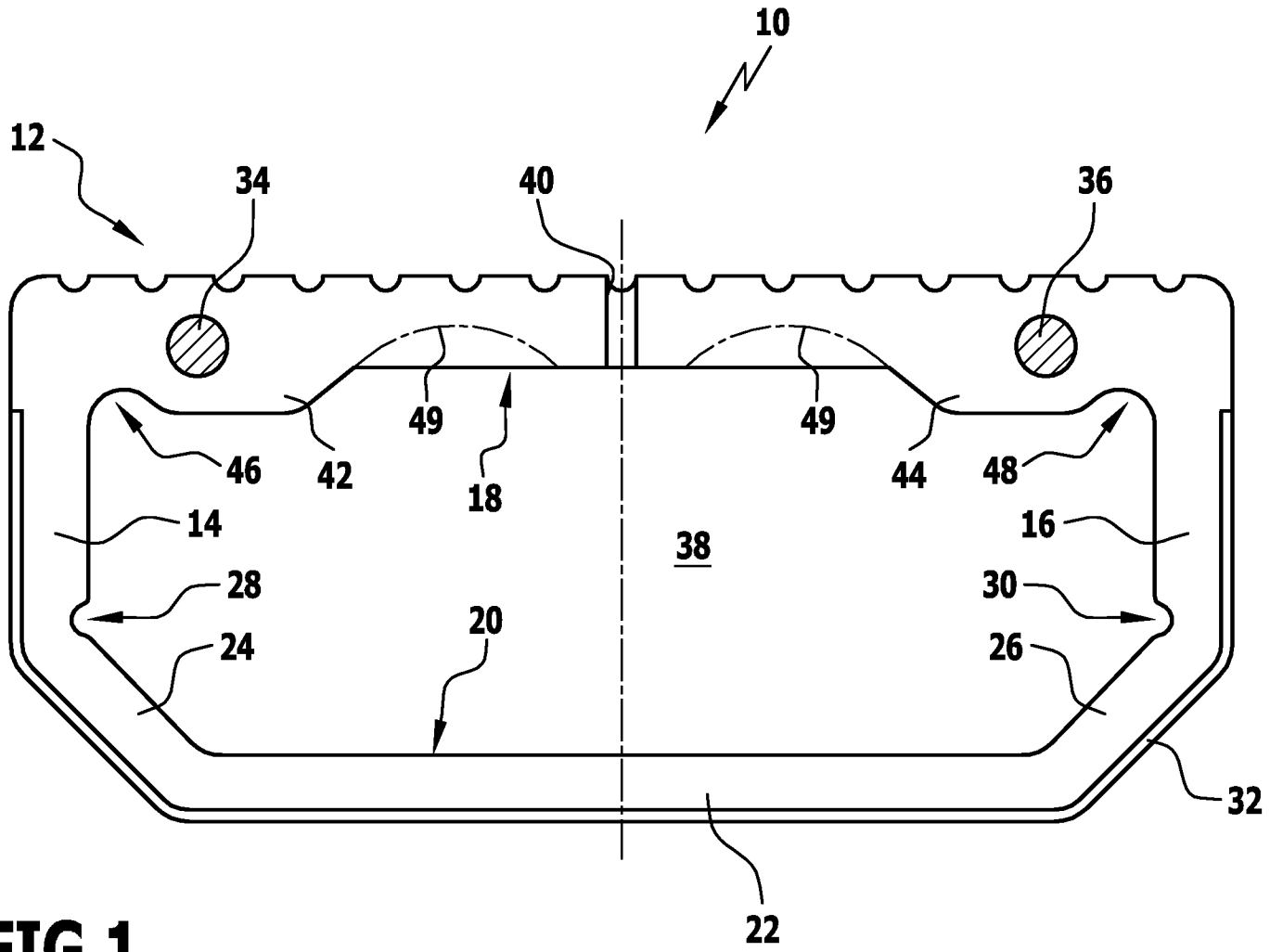
FIG. 1: a first embodiment of a spacer in accordance with the invention.

FIG. 1 shows a spacer 10 in accordance with the invention as per a first embodiment having a profile body 12 that has a first and a second side wall 14, 16 arranged in parallel to each other and spaced apart from each other, between which an inner wall 18 extends.

In parallel to the inner wall 18 and spaced apart therefrom extends from the first to the second side wall an outer wall 20, which has a first (middle) wall section 22 arranged in parallel to the inner wall 18, and second and third wall sections 24, 26 on both sides of the first wall section, which, seen in cross section to the axial direction of the profile body (as depicted here) are aligned at an obtuse angle to the first (middle) wall section 22 and to the respective adjacent side wall 14, 16, and connect thereon.

The wall region of the profile body in which the side wall 14 and the second wall section 24 of the outer wall 20 connect to each other is conceived having a lesser wall strength for the formation of an articulation area 28. The second side wall 16 is likewise connected to the third wall section 26 of the outer wall 20 by way of a wall region having reduced wall thickness for the formation of an articulation area 30.

On the external surface of the spacer 10, in the region reaching from the side wall 14 over the outer wall 20 to the side wall 16, is provided an integral, primary reinforcing element 32, which simultaneously takes over the function of a vapor diffusion barrier.

In the case of the present exemplary embodiment of the spacer 10, the primary reinforcing element 32 is made as stainless steel foil having a thickness of about 0.09 mm, whose mechanical properties are sufficient to strengthen the spacer 10 such that it is cold bendable using conventional cold bending equipment for the formation of corner regions of a spacer frame.

Optionally, the exemplary embodiment of a spacer 10 in accordance with the invention also has embedded in the inner wall 18 a first and a second secondary reinforcing element 34, 36, which are preferably configured as metal wires having a corrugation or thread structure applied on the external surface. The reinforcing elements, which are thus embedded into the plastics material of the inner wall 18 in a manner resistant to shear force, stabilize said inner wall 18 against deformation under the effect of heat, because typical values for the heat expansion in the case of steel are in the range of about 15.7 to about $17*10^{-6}$ 1/K, while unreinforced polypropylene (PP), for example, has a heat expansion in the range of about 130 to about $180*10^{-6}$ 1/K.

The first and the second plastics material in the case of this exemplary embodiment may be selected from a polypropylene copolymer that may also be present foamed in the entire cross section of the spacer. The inner wall 18, the side walls 14, 16, and the outer wall 20 are preferably extruded as one unit.

The profile body 12 encloses a cavity 38 that communicates with an interspace between the panes, which is formed in the installed state by a spacer frame formed from the spacer 10 and two glass panes, merely via through holes or perforations 40, which are arranged the center of the inner wall 18 at regular spacings, and thus receives water vapor contents that are present or penetrating there, as the case may be, which are then bound by a desiccant that is located in the cavity 38 (not shown).

The inner wall 18 in the regions in which the optional secondary reinforcing elements 34, 36 are arranged is formed with a greater thickness than in the remaining wall regions (projections 42, 44), wherein the thickness of the inner wall 18 directly adjacent to the side walls 14 and 16 decreases again, however, such that wall sections having reduced wall thickness are likewise located there as articulation areas 46, 48.

Optionally, the inner wall may have one or more regions 49 in its cross section (dashed-line contour) that have a reduced wall thickness compared to other regions, for example of about 0.3 mm to about 0.4 mm. In the region in which the through holes or perforations 40 are formed, the wall thickness is preferably not reduced and is about 0.9 mm, for example.

Figure 2:
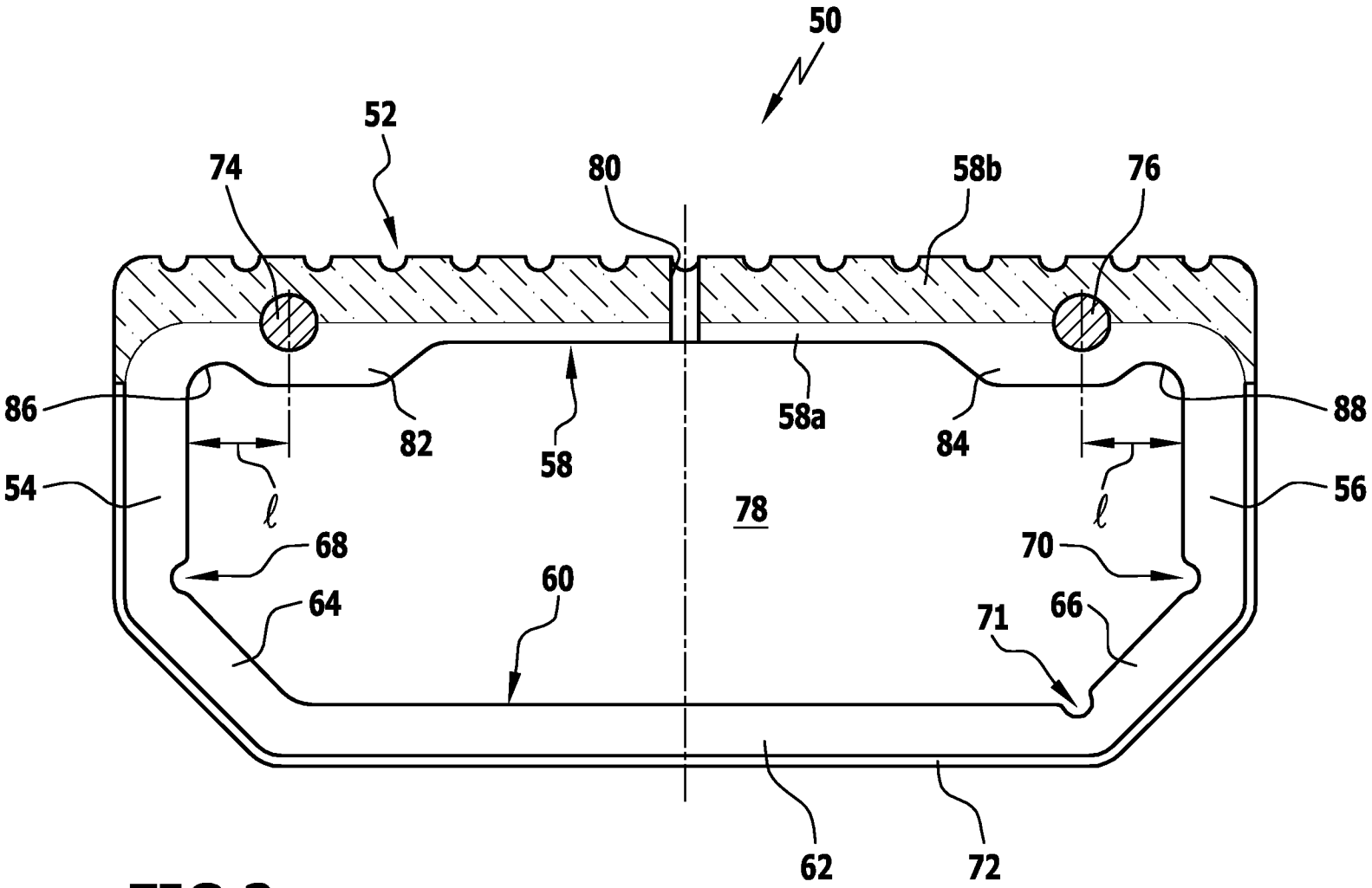
FIG. 2: a second embodiment of a spacer in accordance with the invention.

FIG. 2 shows a spacer 50 in accordance with the invention as per a second exemplary embodiment having a profile body 52 that has a first and a second side wall 54, 56 arranged in parallel to each other and spaced apart from each other, between which an inner wall 58 extends.

In parallel to the inner wall 58, from the first to the second side wall 54, 56, extends an outer wall 60, which has a middle first wall section 62 arranged in parallel to the inner wall 58, and second and third wall sections 64, 66 on both sides of the first wall section 62, which, seen in cross section to the axial direction of the profile body 52 (as depicted here), are aligned at an obtuse angle to the wall section 62 and to the respective adjacent side wall 54 and 56, respectively, and connect thereon.

The wall region in which the first side wall 54 and the second side wall 64 of the outer wall 60 connect to each other is conceived having a reduced wall strength for the formation of an articulation area 68. The second side wall 56 is likewise connected to the third wall section 66 of the outer wall 60 by way of a wall region having reduced wall thickness for the formation of an articulation area 70.

As the case may be, the second and third wall sections 64, 66 may each be connected to the first wall section 62 of the outer wall 60 by way of a wall region 71 having reduced wall thickness for the formation of additional articulation areas (shown in FIG. 2 exemplarily only in the bottom right at the changeover of the third to the first wall section 66 and 62, respectively).

On the external surface of the spacer 50, in the region reaching from the side wall 54 over the outer wall 60 to the side wall 56, is provided an integral, primary reinforcing element 72 which simultaneously takes over the function of a vapor diffusion barrier.

In the case of the present second exemplary embodiment of a spacer 50, the primary reinforcing element 72 is made as stainless steel foil having a thickness of about 0.09 mm, whose mechanical properties are sufficient to strengthen the spacer such that it is cold bendable using conventional cold bending equipment for the formation of corner regions for spacer frames.

Optionally, the exemplary embodiment of a spacer 50 in accordance with the invention also has embedded in the inner wall 58 a first and a second secondary reinforcing element 74, 76, which are preferably configured as metal wires having a corrugation or thread structure applied on the external surface. The spacing l of the center of gravity or center of the cross section of the secondary reinforcing elements 74, 76 to the respective adjacent side wall 54 and 56, respectively, is preferably about 1 mm to about 5 mm, further preferably about 1 mm to about 3 mm.

The profile body 52 encloses a cavity 78 that is in communication with the environment, i.e. in the installed state of an insulting glass pane unit with the thereby formed interspace between the panes, merely via through holes 80 that are arranged in the center of the inner wall 58 at regular spacings.

By way of these through holes or perforations 80, the cavity 78 of the profile body 52 with an interspace between the panes in the installed state of the spacer 50 is thus able to receive water vapor contents that are present or penetrating there, as the case may be, which are then bound by a desiccant that is located in the cavity 78 (not shown).

In this exemplary embodiment, the inner wall 58 is configured to have two layers, wherein a layer 58*a* adjoining the cavity 78 is integrally formed with the side walls 54, 56 and the outer wall 60, for example from polypropylene copolymer, while the external layer 58*b* is produced from a polypropylene homopolymer that is preferably pigmented at customer request, in particular it is coextruded with the interior layer 58*a*. The secondary reinforcing elements 74, 76, if present, each lie about halfway in the external and the interior layer 58*b* and 58*a*, respectively.

In the case that the profile body 52 is provided with a porous structure, the layer 58*a* adjoining the cavity 78 may likewise be configured to be porous, for example foamed, while the external layer 58*b* is preferably configured compactly and not foamed.

The inner wall 58 in the regions in which the secondary reinforcing elements 74, 76 are arranged is, in turn, formed with a greater thickness than in the remaining wall regions (projections 82, 84), wherein the thickness of the inner wall 58 directly adjacent to the side walls 54 and 56 decreases again, however, such that wall sections having lesser wall thickness are likewise located there as articulation areas 86, 88. In the middle region in which the perforations 80 are provided, the wall thickness is preferably about 0.9 mm.

Figure 3:
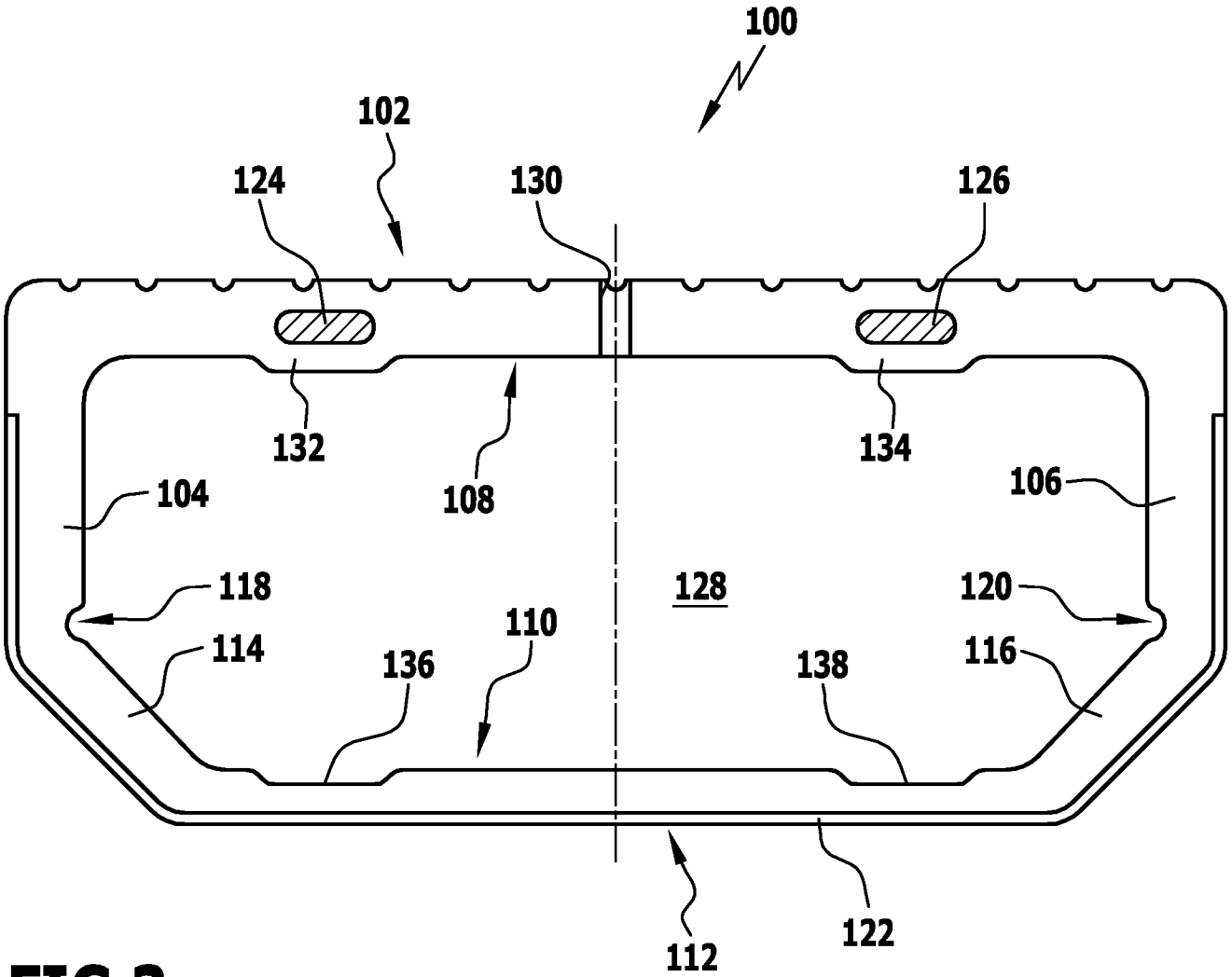
FIG. 3: a third embodiment of a spacer in accordance with the invention.

FIG. 3 shows a spacer 100 in accordance with the invention as per a third exemplary embodiment having a profile body 102 that has a first and a second side wall 104, 106 arranged in parallel to each other and spaced apart from each other, between which an inner wall 108 extends.

In parallel to the inner wall 108, from the first to the second side wall 104, 106, extends an outer wall 110, which has a middle wall section 112 arranged in parallel to the inner wall 108, and second and third wall sections 114, 116 on both sides of the first wall section, which, seen in cross section to the axial direction of the profile body 102 (as depicted here), are aligned at an obtuse angle to the first wall section 112 and to the respective adjacent side wall 104 and 106, respectively, and connect thereon.

The wall region in which the side wall 104 and the second wall section 114 of the outer wall 110 connect to each other is conceived having a lesser wall strength for the formation of an articulation area 118. The second side wall 106 is likewise connected to the third wall section 116 of the outer wall 110 by way of a wall region having reduced wall thickness for the formation of an articulation area 120.

On the external surface of the spacer 100, in a region that reaches from the side wall 104 over the outer wall 110 to the side wall 106, is provided an integral, primary reinforcing element 122 which simultaneously takes over the function of a vapor diffusion barrier.

Optionally, the spacer 100 in accordance with the invention also has embedded in the inner wall 108 a first and a second secondary reinforcing element 124, 126 which are configured here as flat wires from metal having a corrugation applied on the outer surface for anchoring in the surrounding plastics material in a manner that is resistant to shear force.

The profile body 102 encloses a cavity 128 that is in communication with the environment merely via through holes or perforations 130 that are arranged in the center of the inner wall 108 at regular spacings.

By way of these through holes 130, the cavity 128 of the profile body 102 is able to communicate with an interspace between the panes in the installed state of the spacer 100 and thus receive water vapor contents arising there, as the case may be, which then are bound by a desiccant that is located in the cavity 128 (not shown).

In the regions in which the secondary reinforcing elements 124, 126 are arranged, the inner wall 108 is formed with a greater wall thickness than in the remaining wall regions (projections 132, 134), wherein the inner wall 108 adjacent to the side walls 104 and 106 is formed with a lesser wall thickness, however, just as in the center region of the inner wall in which the perforations 130 are provided.

Further, the first wall section 112 of the outer wall 110 opposite to the positions of the secondary reinforcing elements 124, 126 arranged in the inner wall 108 has wall regions 136, 138 with a reduced wall thickness, whose contour corresponds substantially to the contour of the projections 132, 134. The projections 132, 134 are preferably dimensioned such that the wall thickness of the inner wall 108 in these regions is selected larger by about 50% of the thickness of the secondary reinforcing elements 124, 126. The wall strength of the outer wall 110 in the region of the recesses 136, 138 is correspondingly reduced. This facilitates the formation of corner regions upon cold bending of the spacer, in which parts of the inner wall 108 come into abutment with parts of the outer wall 110.

Figure 4:
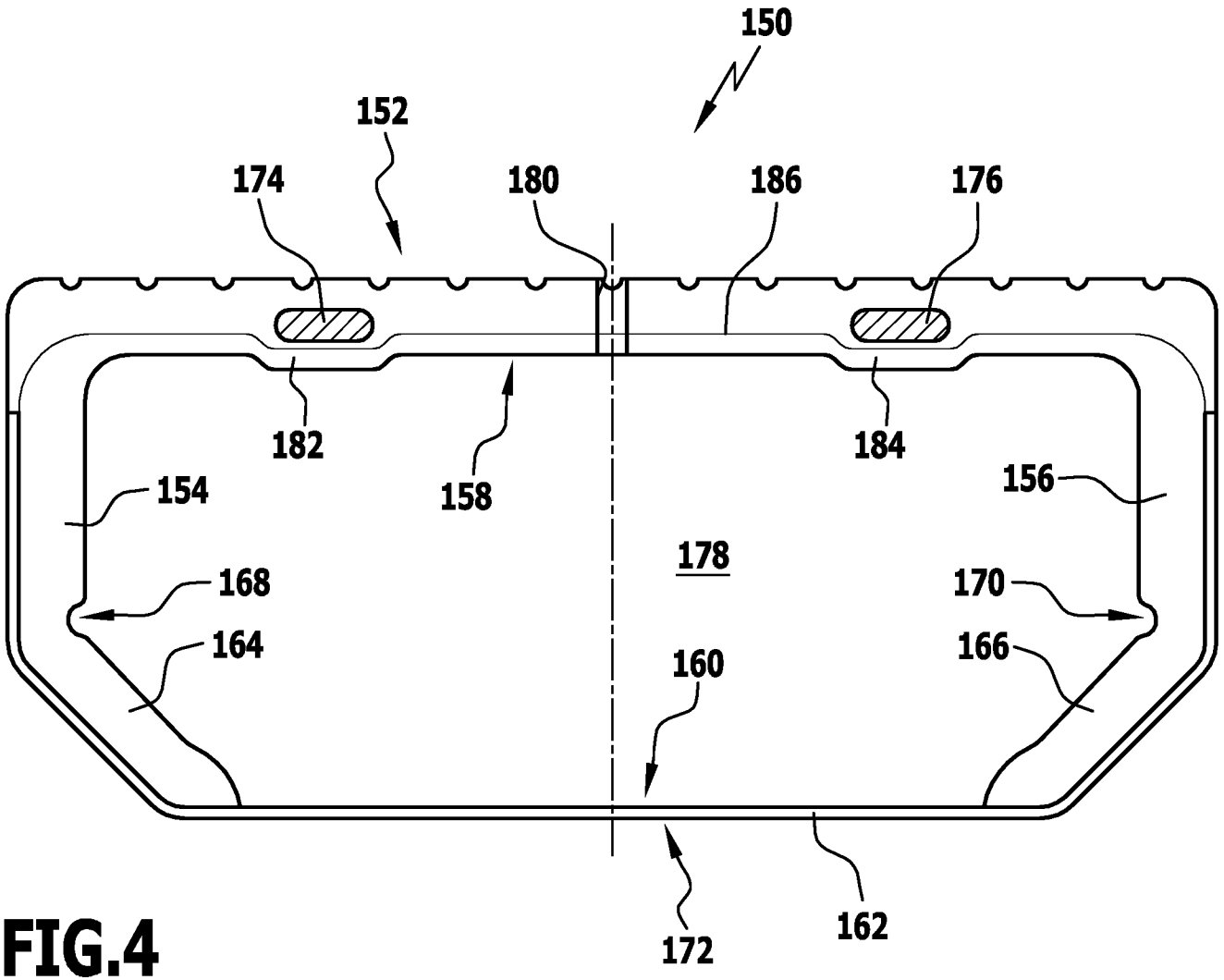
FIG. 4: a fourth embodiment of a spacer in accordance with the invention.

FIG. 4 shows a further spacer 150 in accordance with the invention as per a fourth exemplary embodiment having a profile body 152 that has a first and a second side wall 154, 156 arranged in parallel to each other and spaced apart from each other, between which an inner wall 158 extends.

An outer wall 160, which, deviating from the embodiments of the spacer in accordance with the invention described thus far, has no middle wall section arranged in parallel to the inner wall 158 and made from plastics material, extends in parallel to the inner wall 158 from the first to the second side wall. However, as before, second and third wall sections 164, 166 made from plastics material are present, which, seen in cross section to the axial direction of the profile body 152 (as depicted here), are aligned at an obtuse angle to the respective adjacent side wall 154, 146, and connect thereon.

The wall region in which the side wall 154 and the second wall section 164 of the outer wall 160 connect to each other is conceived having a lesser wall strength for the formation of an articulation area 168. The second side wall 156 is likewise connected to the third wall section 166 of the outer wall 160 by way of a wall region having reduced wall thickness for the formation of an articulation area 170.

On the external surface of the spacer 150, in a region that reaches from the side wall 154 over the second and the third wall section 164, 166 of the outer wall 160 to the side wall 156, is provided an integral, primary reinforcing element 172 which, in addition to the function of a vapor diffusion barrier, also bridges the spacing between the second and third wall sections 164, 166 of the outer wall 160 and thus additionally takes over the function of a first wall section 162.

Also in the case of the present fourth exemplary embodiment of a spacer 150, the primary reinforcing element may be configured as stainless steel foil having a thickness of about 0.09 mm, despite its additional function as first wall section 162, and its mechanical properties are sufficient to strengthen this type of a spacer 150 in accordance with the invention such that it is cold bendable using conventional cold bending equipment for the formation of corner regions. Here too, a material savings and a lower net weight of the profile body are obtained, without the mechanical properties of the spacer 150 being thereby impaired.

Optionally, this exemplary embodiment of a spacer 150 in accordance with the invention may also have embedded in the inner wall 158 a first and a second secondary reinforcing element 174, 176, which are preferably configured as metal wires (here in the form of a flat wire) having a corrugation applied on the external surface.

The profile body 152 encloses a cavity 178 that is in communication with the environment merely via through holes 180 that are arranged in the center of the inner wall 158 at regular spacings.

In the regions in which the secondary reinforcing elements 174, 176 are arranged, the inner wall 158 is formed with a greater thickness than in the remaining wall regions (projections 182, 184), wherein the thickness of the inner wall 158 directly adjacent to the side walls 154 and 156 decreases again, however, such that wall sections having lesser wall thickness are likewise located there as articulation areas 168, 170. After the outer wall 160 in the region of the first wall section 162 is formed by the first reinforcing element 172 alone, the formation of recesses for accommodating the projections 182, 184 is obviated due to the lesser wall thickness.

The inner wall 158 may also be embodied having two layers as needed, as is indicated in FIG. 4 by the dividing line 186. The secondary reinforcing elements may then, as shown here, be fully integrated in the external layer.

Due to the first reinforcing element 172 taking over the function of the first wall section 162 of the outer wall 160, one achieves, in addition to the aforementioned advantages, a gain of space for the cavity 178, such that, with the same constructional size, this spacer 150 in accordance with the invention is able accommodate a greater amount of desiccant and thus provide an increased drying capacity, compared to the spacer 100 of FIG. 3.

Figure 5:
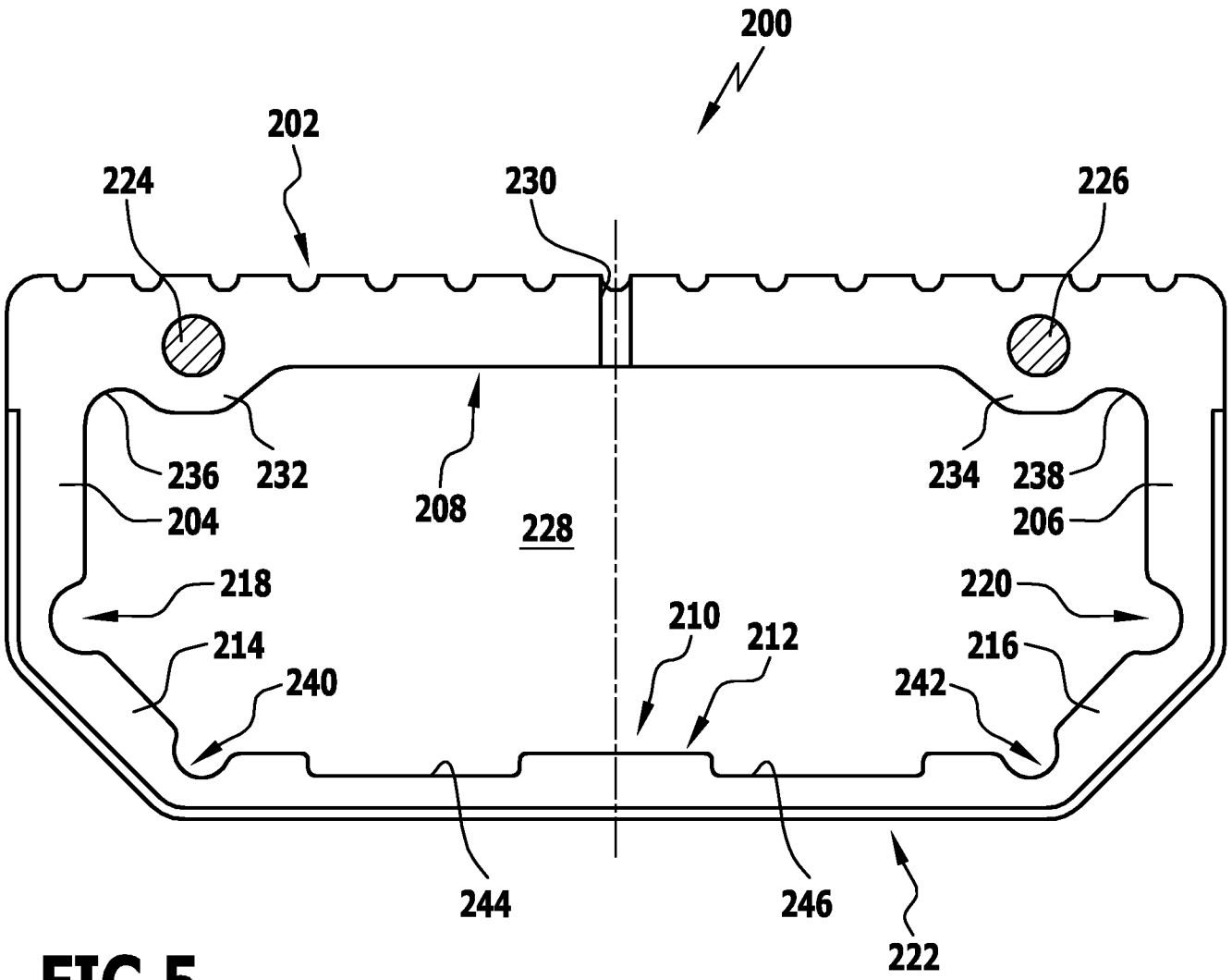
FIG. 5: a fifth embodiment of a spacer in accordance with the invention.

FIG. 5 shows a further spacer 200 in accordance with the invention as per a fifth embodiment having a profile body 202 that has a first and a second side wall 204, 206 arranged in parallel to each other and spaced apart from each other, between which an inner wall 208 extends.

In parallel to the inner wall 208, from the first to the second side wall, extends an outer wall 210, which has a middle wall section 212 arranged in parallel to the inner wall 208, and second and third wall sections 214, 216 on both sides of the first wall section, which, seen in cross section to the axial direction of the profile body (as depicted here), are aligned at an obtuse angle to the first wall section 212 and to the respective adjacent side wall 204, 206, and connect thereon.

The wall region in which the side wall 204 and the second wall section 214 of the outer wall 210 connect to each other is conceived having a lesser wall strength for the formation of an articulation area 218. The second side wall 206 is likewise connected to the third wall section 216 of the outer wall 210 by way of a wall region having reduced wall thickness for the formation of an articulation area 220.

On the external surface of the spacer 200, in a region that reaches from the side wall 204 over the outer wall 210 to the side wall 206, is provided an integral, primary reinforcing element 222, which simultaneous takes over the function of a vapor diffusion barrier.

Optionally, the exemplary embodiment of a spacer 200 in accordance with the invention also has embedded in the inner wall 208 a first and a second secondary reinforcing element 224, 226, which are preferably configured as metal wires having circular cross section and having a corrugation or thread structure applied on the external surface.

The profile body 202 encloses a cavity 228 that is in communication with the environment merely via through holes 230 that are arranged in the center of the inner wall 208 at regular spacings. The cavity 228 serves to accommodate desiccant.

The inner wall 208 in the regions in which the secondary reinforcing elements 224, 226 are arranged is configured having a greater thickness than in the remaining wall regions (projections 232, 234), wherein the thickness of the inner wall 208 directly adjacent to the side walls 204 and 206 decreases again, however, such that wall sections having lesser wall thickness are likewise located there as articulation areas 236, 238.

In addition, the wall regions that form the changeover between the second and the first wall section 214, 212, and between the third and the first wall sections 216, 212 of the outer wall 210, are reduced in their wall thickness and thus form further articulation areas 240, 242, which moreover effect an improvement of the heat transfer resistance.

For further improvement of the heat transfer resistance, provision may be made for additional regions 244, 246 of the first wall section 212 of the outer wall 210 to have reduced wall thicknesses, for example in the range of about 0.3 mm to about 0.4 mm, which are formed as recesses on the side facing the cavity 228.

The regions having reduced wall thickness additionally create a slightly larger volume of the cavity 228, this also applies to the articulation areas 218, 220, 236, 238, 240, 242, which are able, as the case may be, to compensate or even overcompensate the volume proportion of the cavity 228 reduced by the projections 232 and 234.

This applies not only in the context of this embodiment, but generally for all embodiments in which articulation areas and/or wall regions having reduced wall thickness are present in the form of recesses formed on the cavity side.

Figure 6:
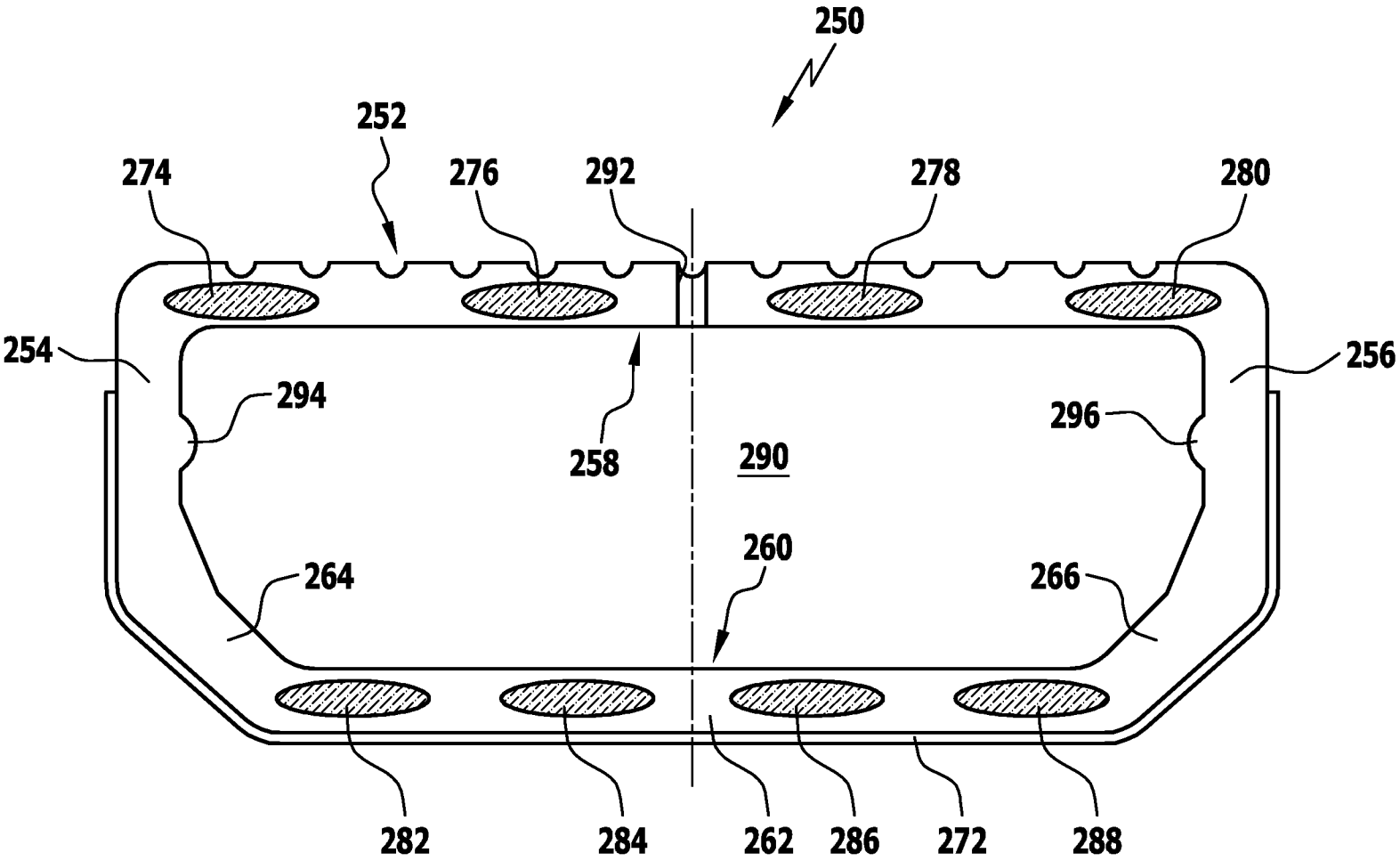
FIG. 6: a sixth embodiment of a spacer in accordance with the invention.

FIG. 6 finally shows a spacer 250 in accordance with the invention as per a sixth embodiment having a profile body 252 that has a first and a second side wall 254, 256 arranged in parallel to each other and spaced apart from each other, between which an inner wall 258 extends.

In parallel to the inner wall 258, from the first to the second side wall 254, 256, extends an outer wall 260, which has a first (middle) wall section arranged in parallel to the inner wall 258, and second and third wall sections 264, 266 on both sides of the first wall section, which, seen in cross section to the axial direction of the profile body 252 (as depicted here), are aligned at an obtuse angle to the wall section 262 and to the respective adjacent side wall 254, 256, and connect thereon.

On the external surface of the spacer 250, in a region that reaches from the side wall 254 over the outer wall 260 to the side wall 256, is provided an integral, primary reinforcing element 272, which simultaneously takes over the function of a vapor diffusion barrier.

In the case of the present sixth exemplary embodiment of a spacer 250, the primary reinforcing element is made as stainless steel foil having a thickness of about 0.09 mm, whose mechanical properties are sufficient to strengthen the spacer such that it is cold bendable using conventional cold bending equipment for the formation of corner regions.

Optionally, the exemplary embodiment of a spacer 250 in accordance with the invention also has embedded in the inner wall 258 and the outer wall 260 rovings which are formed like a non-woven from glass fibers, for example.

Such rovings may also be integrated in the outer wall 260, in particular in its first wall section 262, as shown with the reference numerals 282, 284, 286, 288 in FIG. 6.

The profile body 252 encloses a cavity 290 that is in communication with the environment merely via through holes 292 that are arranged in the center of the inner wall 258 at regular spacings.

By way of these through holes 292, the cavity 290 of the profile body 252 is able to communicate with an interspace between the panes in the installed state of the spacer 250, and thus receive water vapor contents arising there, as the case may be, which then are bound by a desiccant that is located in the cavity 290 (not shown).

While in the embodiments of the spacer 10, 50, 100, 150, 200 in accordance with the invention of FIGS. 1 to 5 the primary reinforcing elements 32, 72, 122, 172, and 222 are integrated into the respective profile body in a flush manner, the primary reinforcing element 272 of the spacer 250 of FIG. 6 is placed on the surface of the profile body 252.

The changeovers of the side walls 254, 256 to the second and third wall sections 265, 266 of the outer wall 260 may optionally be formed with greater wall thicknesses, as shown in this exemplary embodiment, in order to match the cross section of the cavity 290 to existing corner connectors, which are used in case the spacers are not bent in the cold bending method, but rather are cut down to the frame dimensions and are connected to each other in the corner regions by way of a plug connection.

The clamping connection of the spacers with respect to the corner connectors may be further improved if—as shown in this exemplary embodiment—in each case one or two ribs 294, 296 are provided on the side walls 254, 256, which protrude into the cavity 290 from the side walls 254, 256. Further ribs projecting into the cavity 290 (not shown) may optionally be provided on the first wall section 262 of the outer wall.

The invention claimed is:

1. A spacer for insulating glass panes, comprising a profile body configured as a closed hollow profile, which is substantially rectangular in cross section, wherein the profile body has a first side wall and a second side wall arranged in parallel to each other and spaced apart from each other, an inner wall extending between the first side wall and the second side wall, and an outer wall extending from the first side wall to the second side wall and spaced apart from the inner wall, wherein the outer wall has a first wall section aligned substantially in parallel to the inner wall, and a second wall section and a third wall section arranged on both sides of the first wall section, the second wall section and the third wall section, seen in cross section perpendicular to an axial direction of the profile body, being aligned at an obtuse angle to the first wall section and to the respective adjacent side wall, and connect thereon, wherein at least the inner wall, the first side wall and the second side wall, and the second wall section and the third wall section of the outer wall are made using a first plastics material, and wherein the spacer comprises an integral, primary reinforcing element, which is configured as a vapor diffusion barrier, extending from the first side wall over the outer wall to the second side wall, wherein the profile body in wall regions in which the second wall section and the third wall section of the outer wall connect to the first side wall and the second side wall, respectively, has a reduced wall thickness for the formation of articulation areas, wherein the first wall section of the outer wall has additional regions which have reduced thicknesses and which are formed as recesses on a side facing a cavity formed by the profile body.

2. The spacer in accordance with claim 1, wherein the second and third wall sections are planar.

3. The spacer in accordance with claim 1, wherein the primary reinforcing element is a metal foil.

4. The spacer in accordance with claim 1, wherein the profile body is provided with pores, at least in portions of the inner wall and the outer wall.

5. The spacer in accordance with claim 1, wherein the outer wall is partially formed by the primary reinforcing element.

6. The spacer in accordance with claim 1, wherein the first wall section of the outer wall is made from a second plastics material.

7. The spacer in accordance with claim 1, wherein the wall regions configured as articulation areas are formed as grooves on an inner side of the hollow profile or on the profile body outer side.

8. The spacer in accordance with claim 1, wherein a first secondary reinforcing element and a second secondary reinforcing element are arranged in the inner wall in parallel to an axial direction of the spacer profile, wherein the first secondary reinforcing element is arranged in a first section of the inner wall adjacent to the first side wall, and wherein the second secondary reinforcing element is arranged in a second section of the inner wall adjacent to the second side wall.

9. The spacer in accordance with claim 8, wherein an area ratio of a cross sectional area of the first secondary reinforcing element to a sum of cross sectional areas of the secondary reinforcing elements is about 1:1 to about 4:1.

10. The spacer in accordance with claim 8, wherein the secondary reinforcing elements have a spacing to the respective side walls that corresponds to about 10% to about 40% of the spacing between the side walls.

11. The spacer in accordance with claim 8, wherein the secondary reinforcing elements are arranged in the inner wall at a spacing of about 1 mm to about 5 mm from the respective adjacent side wall.

12. The spacer in accordance with claim 8, wherein the secondary reinforcing elements are shaped as flat wires or have a circular cross section.

13. The spacer in accordance with claim 8, wherein the inner wall in a region of the secondary reinforcing elements has projections extending into the cavity of the hollow profile, which have a greater wall thickness than adjacent regions of the inner wall.

14. The spacer in accordance with claim 8, wherein the outer wall in the regions that are opposite the sections of the inner wall accommodating the reinforcing elements has a recess.

15. The spacer in accordance with claim 8, wherein the surface of the secondary reinforcing elements is structured and/or is equipped with a bonding mediator layer.

16. The spacer in accordance with claim 1, wherein the first plastics material comprises a polyolefin, polycarbonate (PC), polyvinylchloride (PVC), styrene-acrylonitrile-copolymer (SAN), polyphenylene ether (PPE), polyester, polyamide (PA) or acrylonitrile butadiene styrene copolymer (ABS), or blends of two or more of these materials.

17. The spacer in accordance with claim 1, wherein a weight ratio of a weight of the primary reinforcing element to a weight of the plastics material is about 1:0.75 to about 1:3.

18. The spacer in accordance with claim 1, wherein the first plastics material has an amount of reinforcing fibers that is about 5% by weight or more and about 20% by weight or less.

19. The spacer in accordance with claim 1, wherein the first plastics material is free of reinforcing fibers.

20. The spacer in accordance with claim 1, wherein the first plastics material comprises additives.

21. The spacer in accordance with claim 8, wherein a thickness of the inner wall directly adjacent to the side walls is reduced compared to a region of the inner wall connecting thereon in a direction to a center of the profile.

22. The spacer in accordance with claim 5, wherein the primary reinforcing element that is arranged in the region of the outer wall or that partially forms the outer wall has a greater elongation at break than the secondary reinforcing elements arranged in the region of the inner wall.

23. The spacer in accordance with claim 8, wherein the first secondary reinforcing element and the second secondary reinforcing element are each arranged adjacent to a part of the hollow volume of the hollow profile, in which the inner wall and the outer wall are spaced apart from each other after bending of the hollow profile by 90° about a bending axis running perpendicularly to a longitudinal direction and parallel to the inner wall.

24. The spacer in accordance with claim 1, wherein the hollow profile upon bending has a neutral axis perpendicular to a longitudinal direction of the spacer and parallel to the inner wall, which is in the range of about 40% to about 60% of a total height of the hollow profile.

25. The spacer in accordance with claim 1, wherein the profile body has an overbending angle for production of a section bent by 90°, which is about 20° or less.

26. The spacer in accordance with claim 1, wherein the inner wall and/or the first wall section, and/or the second wall section and the third wall section of the outer wall have a wall thickness in the range of about 0.3 mm to about 0.7 mm at least in one or more regions of the profile cross section formed from the first plastics material and/or the second plastics material.

27. The spacer in accordance with claim 3, wherein the metal foil is a stainless steel foil having a thickness of about 0.1 mm or less.

28. The spacer in accordance with claim 5, wherein at least the first wall section of the outer wall is substantially entirely formed by the primary reinforcing element.

29. The spacer in accordance with claim 6, wherein the second plastics material of the first wall section of the outer wall is compatible with or identical to the first plastics material.

30. The spacer in accordance with claim 29, wherein the first wall section of the outer wall is integrally formed with the profile body, and wherein the profile body in the wall regions in which the first wall section of the outer wall connects to the second wall section and the third wall section, respectively, are formed with a reduced wall thickness for the formation of articulation areas.

31. The spacer in accordance with claim 13, wherein the greater wall thickness corresponds to a sum of the thickness of the secondary reinforcing elements, measured perpendicularly to a surface of the inner wall, and to the thickness of adjacent regions of the inner wall.

32. The spacer in accordance with claim 14, wherein the recess of the outer wall is formed complementary to a thickening of the regions of the inner wall and has a depth that corresponds to about half of the thickness of the secondary reinforcing elements.

33. The spacer in accordance with claim 20, wherein the additives are selected from fillers, pigments, light stabilizers, impact resistance modifiers, antistatic agents, and/or flame retardants.

34. The spacer in accordance with claim 21, wherein the first secondary reinforcing element and the second secondary reinforcing element are arranged with their cross section entirely in the region of the inner wall.

35. The spacer in accordance with claim 6, wherein the second plastics material has an amount of reinforcing fibers that is about 5% by weight or more and about 20% by weight or less.

36. The spacer in accordance with claim 6, wherein the second plastics material is free of reinforcing fibers.

* * * * *